US008391770B2

(12) United States Patent
Morofuji et al.

(10) Patent No.: US 8,391,770 B2
(45) Date of Patent: Mar. 5, 2013

(54) MEASURING DEVICE OF RECORDING MEDIUM LENGTH, IMAGE FORMING APPARATUS, AND COMPUTER READABLE MEDIUM

(75) Inventors: Koji Morofuji, Tokyo (JP); Takeshi Kato, Kanagawa (JP); Toshiyuki Kazama, Kanagawa (JP); Kozo Tagawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 435 days.

(21) Appl. No.: 12/709,835

(22) Filed: Feb. 22, 2010

(65) Prior Publication Data

US 2011/0076077 A1 Mar. 31, 2011

(30) Foreign Application Priority Data

Sep. 25, 2009 (JP) ..... 2009-220754

(51) Int. Cl.
*G03G 15/00* (2006.01)
*B41J 21/00* (2006.01)

(52) U.S. Cl. ..... 399/389; 399/370

(58) Field of Classification Search ..... 399/370, 399/389

See application file for complete search history.

(56) References Cited

U.S. PATENT DOCUMENTS 5,160,960 A * 11/1992 Ibuchi et al. ..... 355/408
5,764,245 A * 6/1998 Yokoi ..... 347/16
6,091,927 A * 7/2000 Hattori et al. ..... 399/367
6,587,220 B1 * 7/2003 Sato et al. ..... 358/1.16
7,336,393 B2 * 2/2008 Tsutsumi ..... 358/1.9
2007/0025788 A1 * 2/2007 deJong et al. ..... 399/388
2007/0092309 A1 * 4/2007 Willemsens et al. ..... 399/301
2008/0095560 A1 * 4/2008 Larson et al. ..... 399/394
2009/0269091 A1 * 10/2009 Yuasa ..... 399/45
2010/0247115 A1 * 9/2010 Ohshima et al. ..... 399/16

FOREIGN PATENT DOCUMENTS

JP 61210343 A * 9/1986
JP 61292658 A * 12/1986
JP 03103872 A * 4/1991
JP 03137654 A * 6/1991
JP 2005-112543 A 4/2005
JP 2005112543 A * 4/2005

* cited by examiner

*Primary Examiner* — Judy Nguyen
*Assistant Examiner* — Nguyen Q Ha
(74) *Attorney, Agent, or Firm* — Sughrue Mion, PLLC

(57) ABSTRACT

A measuring device of a length of a recording material includes: a rotary unit that rotates while coming into contact with the recording material; a pulse signal output unit that outputs a pulse signal in response to a rotation angle of the rotary unit; first and second detection units that detect the recording material; and a calculation unit that calculates a length of the recording material. The calculation unit calculates a piece of the length of the recording material corresponding to a time below pulse interval of the pulse signal and then calculates the total length in the transport direction of the recording material.

7 Claims, 6 Drawing Sheets

MEASURING DEVICE OF RECORDING MEDIUM LENGTH, IMAGE FORMING APPARATUS, AND COMPUTER READABLE MEDIUM

CROSS-REFERENCE TO RELATED APPLICATION

This application is based on and claims priority under 35 USC 119 from Japanese Patent Application No. 2009-220754 filed on Sep. 25, 2009.

BACKGROUND

Technical Field

The present invention relates to a measuring device of a recording medium length, an image forming apparatus and a computer readable medium.

SUMMARY

According to an aspect of the invention, a measuring device of a length of a recording material includes: a rotary unit that rotates while coming into contact with the recording material when the recording material is transported on the rotary unit; a pulse signal output unit that outputs a pulse signal in response to a rotation angle of the rotary unit; a first detection unit that detects the recording material arranged on an upstream of the rotary unit in a transport direction of the recording material; a second detection unit that detects the recording material arranged on a downstream of the rotary unit in the transport direction of the recording material; and a calculation unit that calculates a length of the recording material, wherein the calculation unit calculates a peace of the length of the recording material corresponding to a time below pulse interval of the pulse signal based on (i) a distance in the transport direction between the first detection unit and the second detection unit and (ii) a period in which one of the first detection unit and the second detection unit detects the recording material, and the calculation unit calculates the total length in the transport direction of the recording material based on (iii) the calculated length, (iv) the distance between the first detection unit and the second detection unit, and (v) the number of pulses outputted from the pulse signal output unit while both of the first detection unit and the second detection unit are detecting the recording material.

BRIEF DESCRIPTION OF THE DRAWINGS

Exemplary embodiments of the invention will be described in detail based on the following figures, wherein.

DETAILED DESCRIPTION

Image Forming Apparatus

Figure 1:
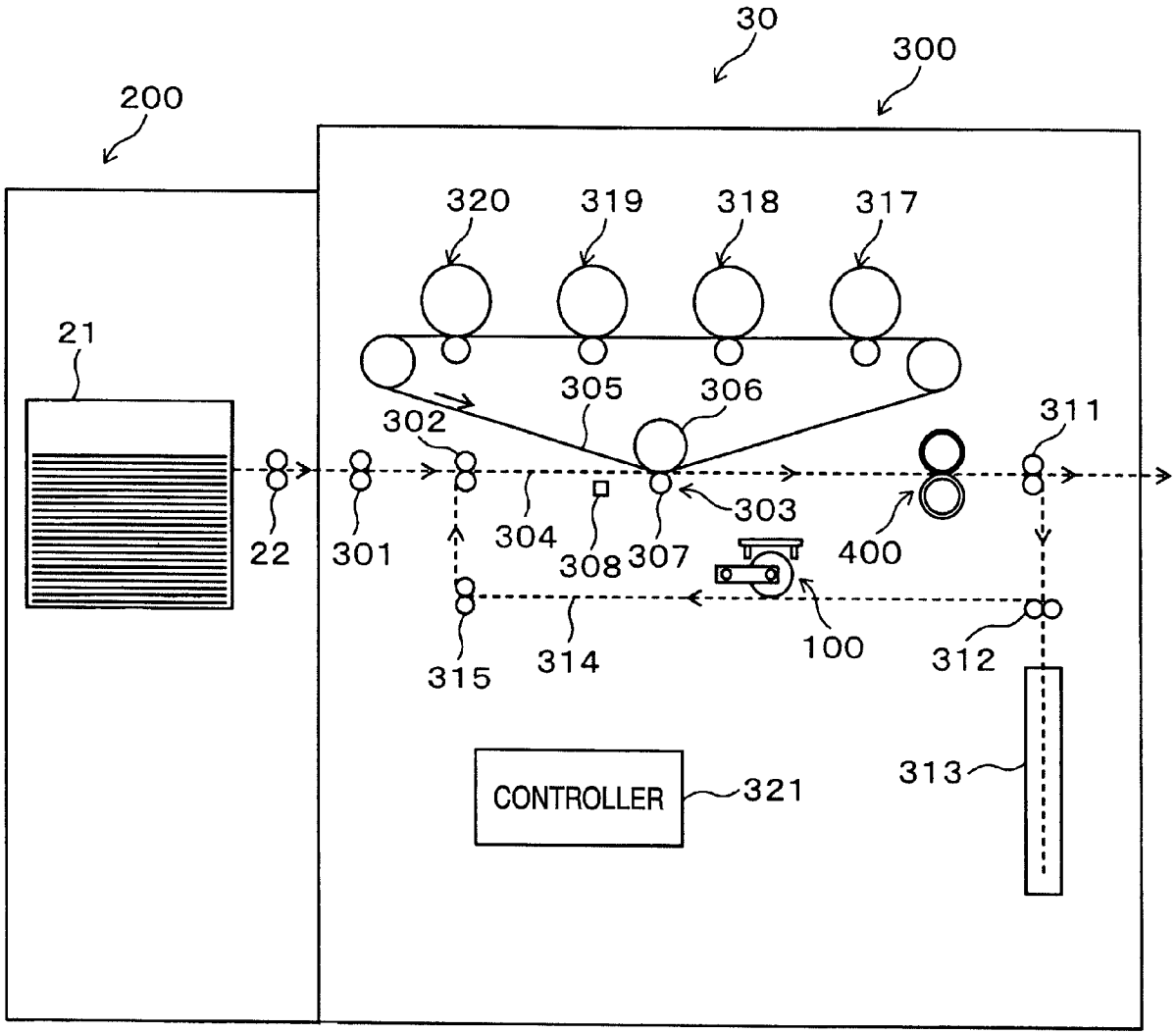
FIG. 1 is a conceptual diagram of an image forming apparatus in an exemplary embodiment.

FIG. 1 is a conceptual diagram of an image forming apparatus in an exemplary embodiment. In FIG. 1, an image forming apparatus 30 is shown. The image forming apparatus 30 includes a sheet supply unit 200 which supplies a sheet that is an example of a recording medium, an image forming unit 300 which is an example of an image forming unit, and a fixing device 400.

Sheet Supply Unit

The sheet supply unit 200 includes a sheet accommodating device 21 which accommodates plural sheets therein, a feed-out mechanism (not shown) which feeds out the sheet from the sheet accommodating device 21 in the right direction in the figure, and a transport roll 22 which transports the sheet fed out from this feed-out mechanism in the right direction. The sheet is a sheet-like recording material, and described as paper in this exemplary embodiment. The recording material is not limited to paper, but may be a sheet-like resin material (for example, OHP sheet) or a paper material coated with resin.

Image Forming Unit

The image forming unit 300 includes a transport roll 301 which brings the paper fed out from the sheet supply unit 200 into the image forming unit 300. On the downstream side of the transport roll 301, a transport roll 302 is arranged which feeds out the paper fed out from the transport roll 301 or the paper fed out from a transport roll 315 described later toward a secondary transfer section 303. The secondary transfer section 303 includes a transfer roll 306 and an opposite roll 307, between which a transfer belt 305 and the paper are nipped, thereby to transfer a toner image on the transfer belt 305 onto the paper.

A reference numeral 308 is a sheet detection sensor for detecting optically the paper transported toward the secondary transfer section 303. The sheet detection sensor 308 detects optically the transported paper. The sheet detection sensor 308 detects the paper position on a transport path 304, and outputs the detection result to a controller 321 described later.

On the downstream side of the secondary transfer section 303, a fixing device 400 is arranged, which fixes the toner image on the paper onto the paper. On the downstream side of the fixing device 400, a transport roll 311 is arranged. The transport roll 311 feeds out the paper fed out from the fixing device 400 toward the outside of the apparatus or toward a transport roll 312.

In case that image formation is performed on both sides of the paper, at the stage when the image formation is completed on a first surface (first side) (at the stage when the fixing operation is completed), the transport roll 311 feeds out the paper to the transport roll 312. This paper is fed to an inverter 313. The inverter 313 returns (switches back) the fed-in paper toward the transport roll 312, and the transport roll 312 feeds out the paper exhausted from the inverter 313 to a transport path 314. At this time, the paper to be transported on the transport path 314 is transported in a state where sides are inverted compared with the case where the paper is firstly transported on the transport path 304.

On the transport path 314, a length measuring part 100 described later is arranged. The paper fed out on the transport path 314 is subjected to length-measurement in the transport direction by the length measuring part 100, then sent from the transport roll 315 to the transport roll 302, and thereafter fed out to the transport path 304. The paper transported again on the transport path 304 is sent to the secondary transfer section 303, and subjected to image secondary transfer onto a second side.

Regarding the image to be formed on this second side, control of primary transfer and control of secondary transfer are performed on the basis of information of the length in the paper transport direction measured by the length measuring part 100. This is performed in order to prevent misalignment in the position of the image formation on the second side, which is caused by change in dimension of the paper produced by the influence of the image formed on the first side.

The image forming unit 300 includes primary transfer units 317, 318, 319 and 320. Each of these primary transfer units includes a photoconductor drum, a cleaning device, a charging device, an exposure device, a development device, and a transfer roll. The primary transfer units 317, 318, 319 and 320 transfer toner images of Y (yellow), M (magenta), C (cyan), and K (black) on the circulating transfer belt 305 in a multi-layered-manner. Hereby, the toner images of YMCK are multilayered, with the result that a color toner image is formed on the transfer belt 305.

The control of the operation of each component described above is performed by the controller 321. The controller 321 performs various calculations for measuring the sheet length in the transport direction by the described-later method. Further, the controller 321, in image formation on the second side when the image formation is performed on both sides of paper, performs the control of image formation in consideration of change in dimension of the paper on the basis of the sheet length data obtained by the length measuring part 100.

Length Measuring Part

Figure 2:
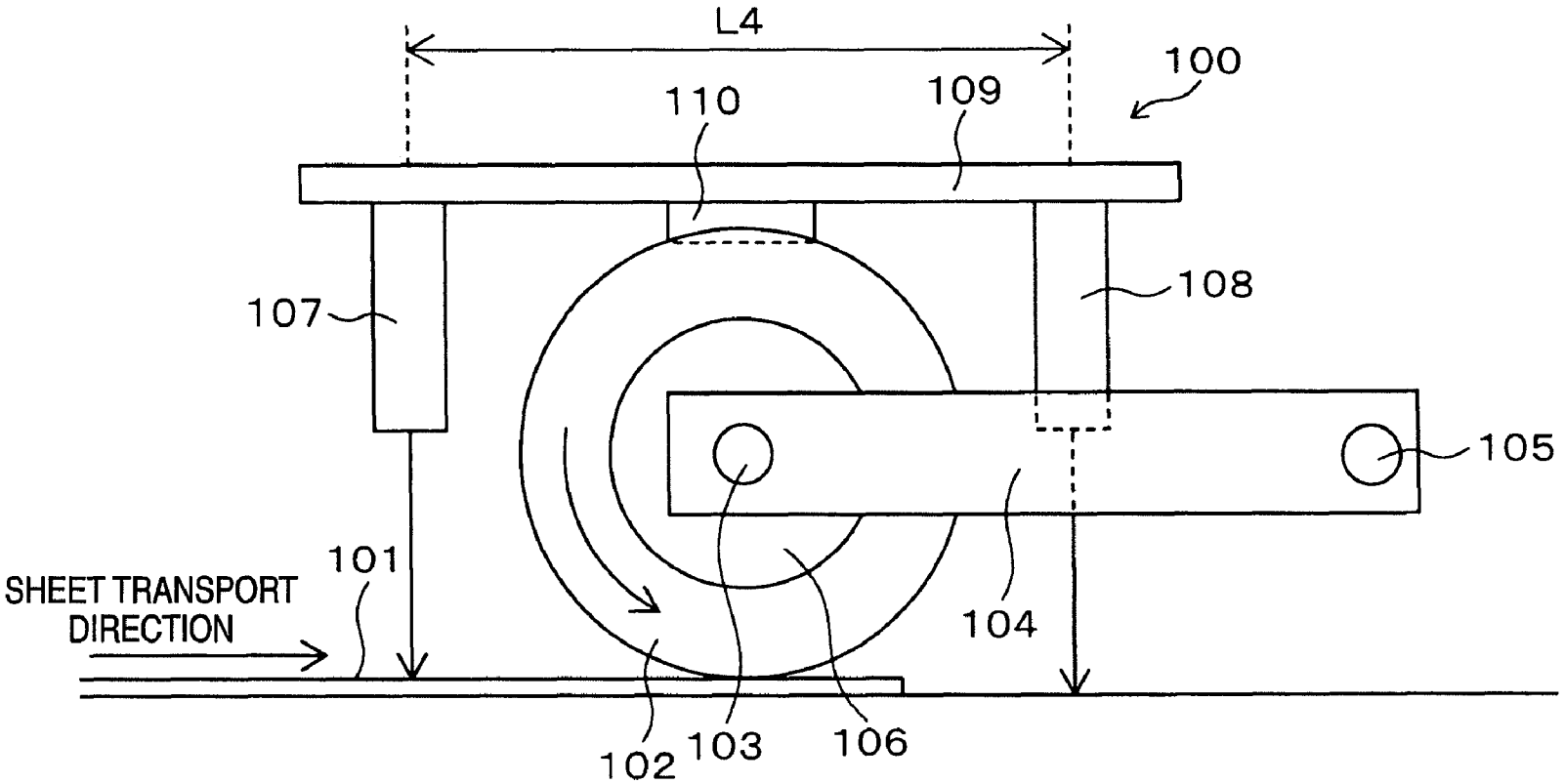
FIG. 2 is a conceptual diagram of a part which measures a sheet length.

FIG. 2 shows a conceptual diagram of the length measuring part 100 in FIG. 1. In the length measuring part 100 of FIG. 2, paper 101 is transported from the left to the right in the figure. Reference numeral 102 is a length measuring roller that is a rotator for length measurement. The length measuring roller 102 includes a rotational shaft 103, and the rotational shaft 103 is supported rotatably by a support arm 104.

The support arm 104 is attached to a housing of the image forming unit 300 (refer to FIG. 1) in a swingable state by a pivot shaft 105. Further, a rotational shaft of a rotary encoder 106 which outputs information on rotation angle by means of pulse signals is coupled to the rotational shaft 103. A main body of the rotary encoder 106 is fixed to the support arm 104.

The length measuring roller 102 can swing in the up and down direction in the figure around the pivot shaft 105. At this time, following the up-and-down movement of the length measuring roller 102, the rotary encoder 106 also swings up and down.

In FIG. 2, a first edge sensor 107 and a second edge sensor 108 are shown. The first edge sensor 107 is arranged on the upstream side of the length measuring roller 102 seen from the transport direction of the paper 101, and the second edge sensor 108 is arranged on the downstream side of the length measuring roller 102.

The first edge sensor 107 and the second edge sensor 108 are photoelectric sensors for detecting an edge portion of paper. The first edge sensor 107 and the second edge sensor 108 include respectively a light emission diode (not shown) and a photo diode (not shown). From the light emission diode, detection light is emitted in a direction of an arrow in the figure, and the reflection light from the emitted light is detected by the photo diode, whereby the edge portion of the paper 101 is detected.

For example, when a front end portion (front edge) of the paper 101 passes under the first edge sensor 107, the output of the first edge sensor 107 changes from a not-detection state (L-output level) to a detection level (H-output level). When the back end portion (back edge) of the paper 101 passes under the first edge sensor 107, the output of the first edge sensor 107 changes from a detection level (H-output level) to a not-detection state (L-output level). Hereby, the edge sensor 107 detects optically the front end portion and the back end portion of the paper 101. This detection is performed similarly also in case of the second edge sensor 108. A term "front" unit a front direction seen from the transport direction, and a term "back" unit an opposite direction to the front direction.

The first edge sensor 107 and the second edge sensor 108 are attached to a base board 109. A temperature sensor (thermistor) 110 which is composed of a temperature measuring resistor is attached between the two sensors. The temperature sensor 110 comes into contact with the base board 109 and detects the temperature of the base board 109.

Operation of Length Measuring Part

In the course of transport of the paper 101 in FIG. 2 from the left in the figure to the right, the paper 101 comes into contact with the length measuring roller 102. At this time, with the movement of the paper 101, the length measuring roller 102 coming into contact with the paper 101 rotates in the counterclockwise direction in the figure. This rotation is detected by the rotary encoder 106, and the pulse electric signal in response to the rotation angle is outputted from the rotary encoder 106.

Further, In the course of the transport of the paper 101, when the front end portion and the back end portion of the paper 101 pass through each sensor position, the output indicating the passage is produced from the first edge sensor 107 and the second edge sensor 108.

Constitution of Control System

Figure 3:
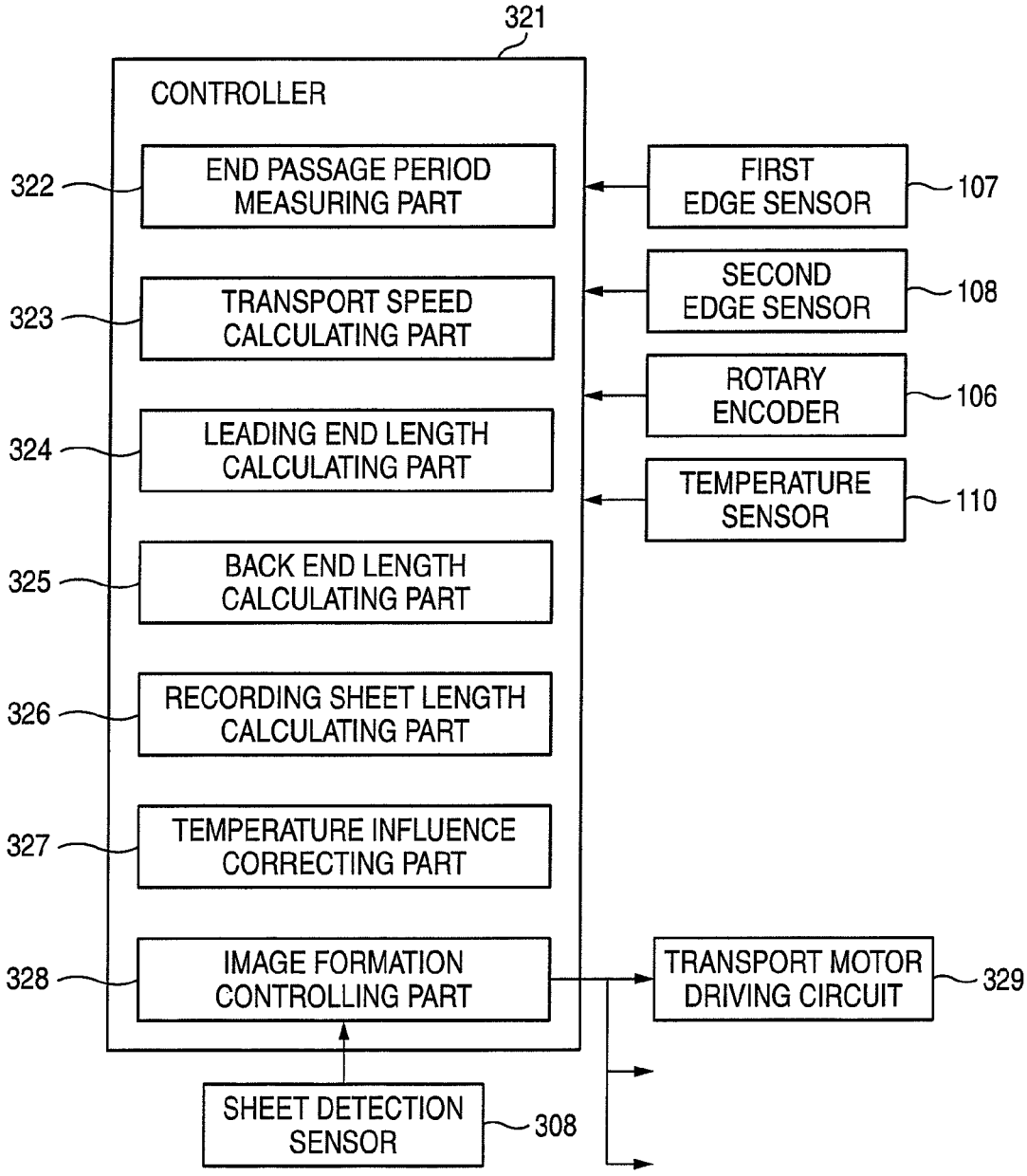
FIG. 3 is a block diagram of a control system.

FIG. 3 is a block diagram showing the constitution of the controller 321 and the peripheral constitution of the controller 321. In FIG. 3, the controller 321 shown also in FIG. 1 is shown. The controller 321 has a function of a microcomputer, and includes a CPU, a memory, a base clock, an interface. The controller 321 executes processing shown in a flowchart described later.

The controller 321 includes an period measuring part 322 (an end passage period measuring part 322), a transport speed calculating part 323, a leading end length calculating part 324, a back end length calculating part 325, a recording sheet length calculating part 326, a temperature influence correcting part 327, and an image formation controlling part 328. These parts are constituted in software, and fulfill the later-described functions.

The period measuring part 322, on the basis of the outputs from the first edge sensor 107 and the second edge sensor 108, measures a period for which the front end portion and the back end portion of the paper 101 pass between the first edge sensor 107 and the second edge sensor 108.

The transport speed calculating part 323 performs processing necessary to obtain the transport speed of the paper 101 at a determined period. The leading end length calculating part 324 performs processing necessary to obtain the length of the leading end portion of the paper 101. The back end length calculating part 325 performs processing necessary to obtain the length of the back end portion of the paper 101.

The recording sheet length calculating part 326 performs processing necessary to obtain the length in the transport direction of the paper 101. The temperature influence correcting part 327 stores a corresponding table data between the dimension of L4 in FIG. 2 examined in advance and the temperature of the base board 109, and corrects the value of L4 in response to temperature change.

The image formation controlling part 328 controls the image formation performed by the image forming unit 300 (refer to FIG. 1). FIG. 3 shows, as an example, the constitution in which the operation control of a transport motor 329 not shown in FIG. 1 is performed by the image formation controlling part 328. The transport motor 329 is a motor for driving, for example, the transport roll 302 shown in FIG. 1. In FIG. 3, the image formation controlling part 328 performs also the operation controls of the primary transfer units 317, 318, 319 and 320, and the operation control of the transfer belt 305, though their controls are not shown.

Example of Image Forming Operation

In the image forming apparatus 30 shown in FIG. 1, an example of the operation in case that image formation is performed on both sides of the paper will be described below. First, the paper is fed out from the paper accommodating device 21 through the transport roll 22. This paper is supplied from the transport path 304 to the secondary transfer section 303. In accordance with this timing, toner images are formed on the transfer belt 305 by the primary transfer units 317 to 320. Thereafter, the toner images on this transfer belt 305 are secondarily transferred, in the secondary transfer section 303, on the paper transported in the right direction of the figure on the transport path 304. The secondarily transferred toner image is fixed on the paper by the fixing device 400. Thus, the image formation on the first side of the paper is performed.

The paper in which the image formation on one side has been completed is fed out from the transport 311 to the inverter 313. The paper fed in the inverter 313 is switched back there, and fed out from the transport roll 312 to the transport path 314 in a state where the second side that is a back side of the first side becomes an upper surface. When the paper fed out to the transport path 314 passes through the length measuring part 100, the paper length is measured by the length measuring part 100. A measuring method of paper length in this time will be described later.

The paper measured by the length measuring part 100 is fed out again to the transport path 304 through the transport rolls 315 and 302. In accordance with this timing, toner images for forming an image on the second side of the paper are formed on the transfer belt 305 by the primary transfer units 317 to 320. At this time, on the basis of the paper length data measured by the length measuring part 100, scale size of the toner image to be formed (primarily transferred) on the transfer belt 305 is adjusted. This control is performed by the image formation controlling part 328 in FIG. 3.

This toner image is, in the secondary transfer section 303, secondarily transferred on the second side of the paper of which the length has been measured by the length measuring part 100. At this time, the paper is detected by the paper detection sensor 308, and timing of the secondary transfer in the secondary transfer section 303 is controlled on the basis of this detection result and the paper length data measured by the length measuring part 100. This control is performed by the image formation controlling part 328 in FIG. 3.

Thereafter, the paper is sent to the fixing device 400, where the image formed on the second side is fixed. The paper in which the image on the second side has been fixed is exhausted from the transport roll 311 to the outside of the image forming unit 300.

Example of Measuring Operation of Paper Length: Outline

Figure 4:
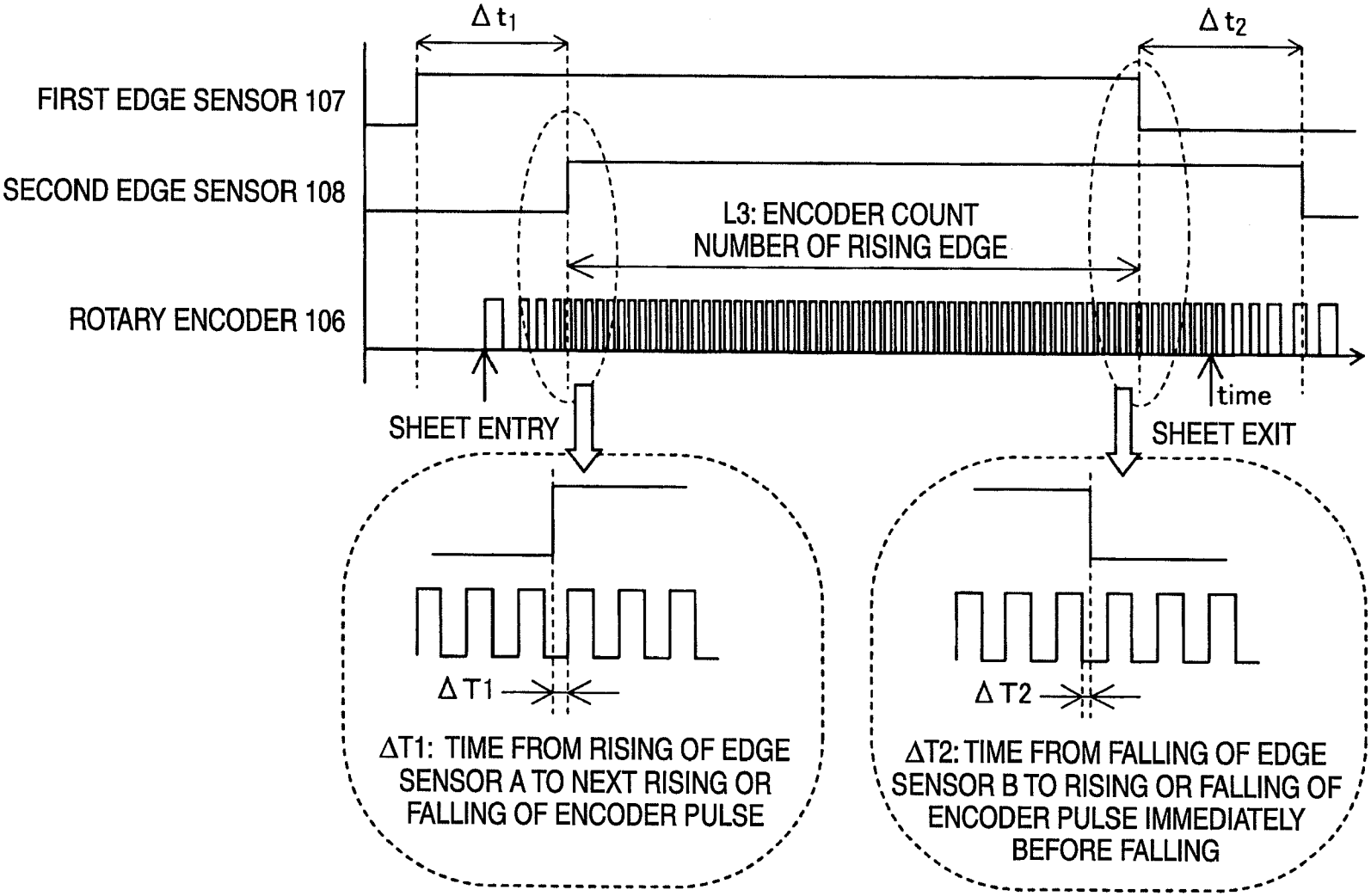
FIG. 4 is a principle diagram showing the measurement principle of sheet length.

A procedure of measuring the paper length by means of the length measuring part 100 will be described below. First, the outline of the whole will be described. FIG. 4 is a principle diagram showing the principle of measurement of the paper length. In FIG. 4, a horizontal axis represents a time axis.

In FIG. 4, the event occurring when the paper 101 arrives at the length measuring part 100 of FIG. 2 is shown. As shown in FIG. 4, when the paper 101 arrives at the length measuring part 100, the front end (front edge) of the paper is first detected by the first edge sensor 107, and the output from the first edge sensor 107 changes from L to H. Thereafter, the paper 101 comes into contact with the length measuring roll 102 (enters the length measuring roll 102), whereby the length measuring roll 102 starts rotating, and the pulse of the rotary encoder 106 starts being outputted. Next, the front edge of the paper 101 is detected by the second edge sensor 108, and the output from the second edge sensor changes from L to H.

Since accuracy of measurement by the output pulse of the rotary encoder 106 is limited by pulse interval, a length Lin of the paper front end buried in the pulse interval is calculated, utilizing timing in which the front end of the paper 101 passes under the second edge sensor 108.

At this time, the [XOR] period of the outputs of the first edge sensor 107 and the second edge sensor 108 (the period in which the output of either sensor is H) is measured, whereby $\Delta t_1$ in FIG. 4 is obtained. Using this $\Delta t_1$ and L4 (distance between the edge sensors) in FIG. 2, a transport speed V1 in the period $\Delta t_1$ is calculated. Using this transport speed V1 and $\Delta$T1, Lin is calculated. The length Lin of the paper front end corresponds to the length below the output pulse interval of the rotary encoder 106. This point is the same also in the length Lout of the paper back end described later.

Next, L3 is calculated from the output pulse of the rotary encoder 106. Then, a length Lout of the paper back end buried in the pulse interval is calculated, utilizing timing in which the back end of the paper 101 passes under the first edge sensor 107.

At this time, the [XOR] period of the outputs of the first edge sensor 107 and the second edge sensor 108 (the period in which the output of either sensor is H) is measured, whereby $\Delta t_2$ in FIG. 4 is obtained. Using this $\Delta t_2$ and L4 (distance between the edge sensors) in FIG. 2, a transport speed V2 in the period $\Delta t_2$ is calculated. Using this transport speed V2 and the $\Delta$T2, Lout is calculated.

Here, Lin+Lout+L3 is the paper length measured at the period in which both the output of the first edge sensor 107 and the output of the second edge sensor 108 are H, that is, the paper exists under the both sensors. Therefore, Lin+Lout+L3+L4 obtained by adding L4 (distance between edge sensors) that becomes the transport distance during passage under only one edge sensor to Lin+Lout+L3 is calculated as length in the transport direction of the paper 101.

Example of Measuring Operation of Paper Length: Detail

Figure 5:
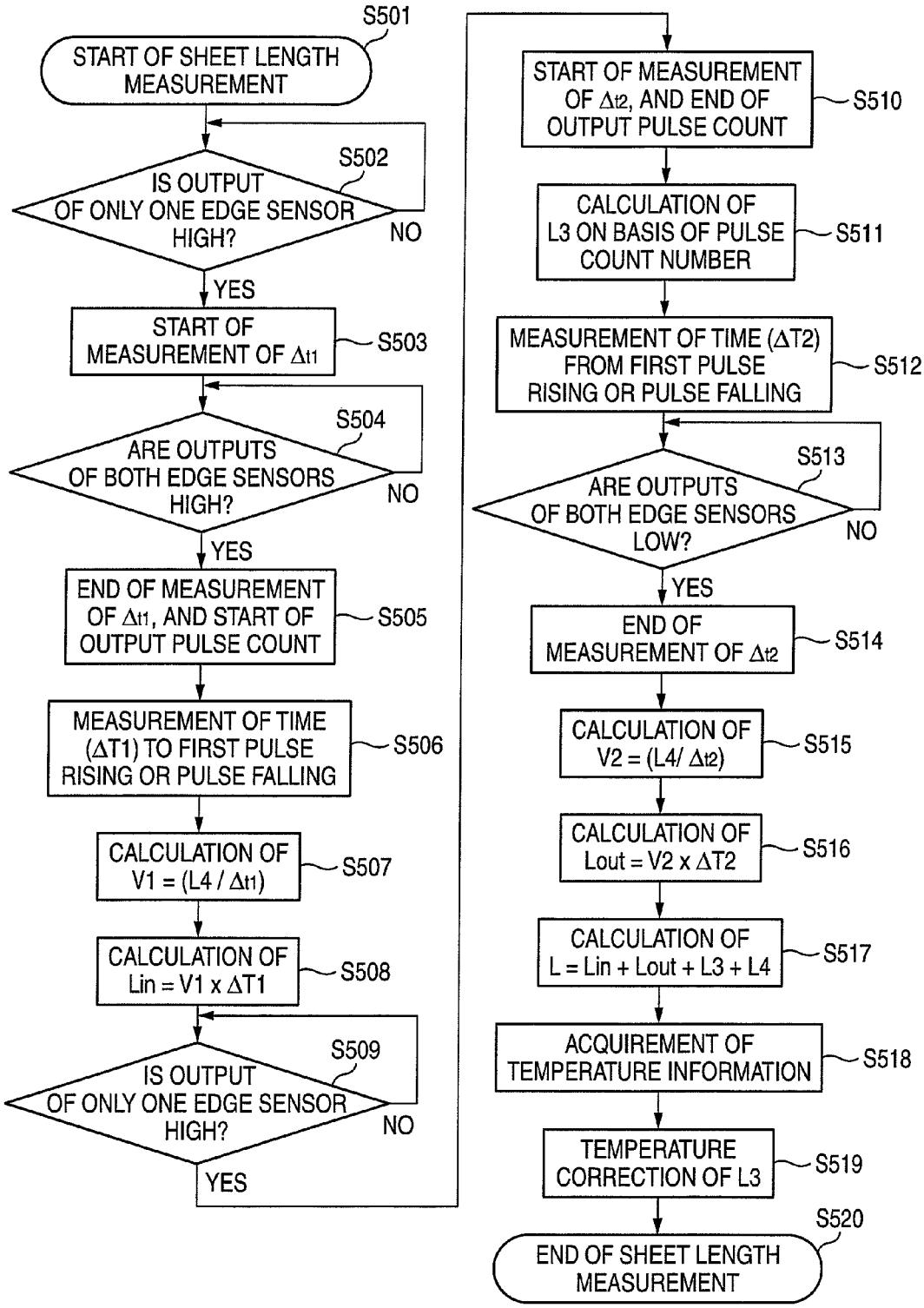
FIG. 5 is a flowchart showing a procedure of processing when the measurement of the sheet length is performed.

FIG. 5 is a flowchart showing an example of processing procedure when the paper length is measured by means of the length measuring part 100. A program for executing the flowchart shown in FIG. 5 is stored in a memory included in the controller 321, read out in an appropriate memory area, and executed by the CPU in the controller 321. The program for executing the flowing chart shown in FIG. 5 may be stored in an appropriate recording medium and may be supplied from its recording medium.

As soon as the paper 101 approaches the length measuring part 100, processing shown in FIG. 5 is started. When the processing is started (step S501), whether the output of only either of the first edge sensor 107 and the second edge sensor 108 is H or not, that is, whether the outputs of the both sensors are [XOR] or not is determined (step S502).

In case that the output of only either sensor is H, the operation proceeds to a step S503. In case that the output of only either sensor is not H, the operation of the step S502 is repeated. In the step S503, the measurement of $\Delta t_1$ in FIG. 4 is started. This measurement is performed by the period measuring part 322 in FIG. 3.

Next, whether the outputs of both of the first edge sensor 107 and the second edge sensor 108 are H or not is determined (step S504). In case that the outputs of both edge sensors are H, the operation proceeds to a step S505. In case that the outputs of both sensors are not H, the operation in the step S504 is repeated. In the step S505, the measurement of $\Delta t_1$ is completed, and count of the output pulses of the rotary encoder 106 is started. The count of the output pulses of the rotary encoder 106 is performed by the recording sheet length calculating part 326 in FIG. 3.

After the step S505, the operation is proceeds to a step S506. In the step S506, passage time ($\Delta T1$) from the start of the output pulse count of the rotary encoder 106 in the step S505 to first pulse rising or falling is measured. This measurement is performed by the leading end length calculating part 324 in FIG. 3.

Next, from the $\Delta t_1$ obtained in the step S505 and the value of L4 in FIG. 2, $V1=(L4/\Delta t_1)$ is calculated (step S507), whereby the transport speed V1 of the paper when the measurement in the step S506 (measurement of $\Delta T1$) is performed is calculated. This processing is performed by the transport speed calculating part 323 in FIG. 3.

After the step S507, using $\Delta T1$ obtained in the step S506, $Lin=V1\times\Delta T1$ is calculated, whereby Lin corresponding to the distance by which the paper moves at the $\Delta T1$ period is found (step S508). Lin is the distance by which the paper moves from the time when the front end of the paper 101 passes under the second edge sensor 108 to the time when the output pulse of the rotary encoder 106 thereafter rises or falls firstly (at the period of $\Delta T1$). The calculation of Lin is performed by the leading end length calculating part 324 in FIG. 3.

The processing in the step S506 and the step 508 is equivalent to the calculation of $Lin=(L4/\Delta t_1)\times\Delta T1$. Accordingly, the processing in the step S506 and the step 508 is processing for calculation of the moving distance Lin of the leading end portion of the paper 101 at the period $\Delta T1$, using the period $\Delta T1$ from the start of the paper detection by the second edge sensor 108 to rising or falling of a pulse wavelength outputted from the rotary encoder 106, and the period $\Delta t_1$ in which the first edge sensor 107 detects the paper 101 but the second edge sensor does not detect the paper 101.

Next, whether the output of only either of the first edge sensor 107 and the second edge sensor 108 is H or not is determined (step S509). In case that the output of only either sensor is H, the measurement of $\Delta t_2$ is started, and also the count of the output pulses from the rotary encoder 106 started in the step S505 is completed (step S510).

Next, while both of the first edge sensor 107 and the second edge sensor 108 are detecting the paper 101, the moving distance L3 of the paper 101 at the period in which the pulse count of the rotary encoder 106 is performed is calculated (step S511). Specifically, since the dimension corresponding to one pulse is known in advance, the pulse count number of the rotary encoder 106 at the above period is multiplied by the passage time in which its pulse count is obtained, which is obtained by the base clock included in the controller 321

Further, after the measurement of $\Delta t_2$ in the step S510 has been started, first rising/falling of the output pulse from the rotary encoder 106 immediately before its measurement is detected, and the time when this rising/falling of the output pulse is produced is acquired. Then, a time interval $\Delta T2$ between this time and the time when the measurement of the above $\Delta t_2$ is started (namely, the time when the output of the second edge sensor 108 becomes from H to L) is measured (step S512). This measurement is performed by the transport speed calculating part 323 in FIG. 3.

Next, whether the outputs of both of the first edge sensor 107 and the second edge sensor 108 are L or not is determined (step S513). In case that the outputs of the both sensor are L (the both sensors do not detect the paper), the measurement of $\Delta t_2$ is completed (step S514). In case that the outputs are not so, the determination in the step S513 is repeated.

After the step S514, $V2=(L4/\Delta t_2)$ is calculated by the transport speed calculating part 323 in FIG. 3 (step S515). Next, using the $\Delta T2$ obtained in the step S512, $Lout=V2\times\Delta T2$ is calculated by the back end length calculating part 325 in FIG. 3 (step S516).

Lout is the distance by which the paper moves from the time when the back end of the paper 101 passes under the first edge sensor 107 to the time when the output pulse of the rotary encoder 106 rises or falls at immediately back timing of its passage time (at the period of $\Delta T2$).

The processing in the step S515 and the step S16 is equivalent to the calculation of $Lout=(L4/\Delta t_2)\times\Delta T2$. Accordingly, the processing in the step S515 and the step S16 is processing for calculation of the moving distance Lout of the back end portion of the paper 101 at the period $\Delta T2$, using the period $\Delta T2$ from the completion of the paper detection by the first edge sensor 107 to rising or falling of a pulse wavelength outputted from the rotary encoder 106 immediately before the completion of the detection, and the period $\Delta t_2$ in which the first edge sensor 107 does not detect the paper 101 but the second edge sensor 108 detects the paper 101.

Next, using Lin obtained in the step S508, L3 obtained in the step S511, Lout obtained in the step S516, and the value of L4 in FIG. 2, L=Lin+Lout+L3+L4 is calculated (step S517). This calculation is performed by the recording sheet length calculating part 326 in FIG. 3.

Next, the temperature information of the base board 109 is acquired by the output from the temperature sensor 110 (step S518). Then, on the basis of the temperature information of the base board 109, the value of L4 in L calculated in the step S517 is corrected (step S519). This correction is performed on the basis of a data table indicating the previously researched relation between the value of L4 and the temperature. Thereafter, processing of the sheet length measurement is completed (step S520). Thus, the length L in the transport direction of the paper 101 is measured.

Superiority

Figure 6:
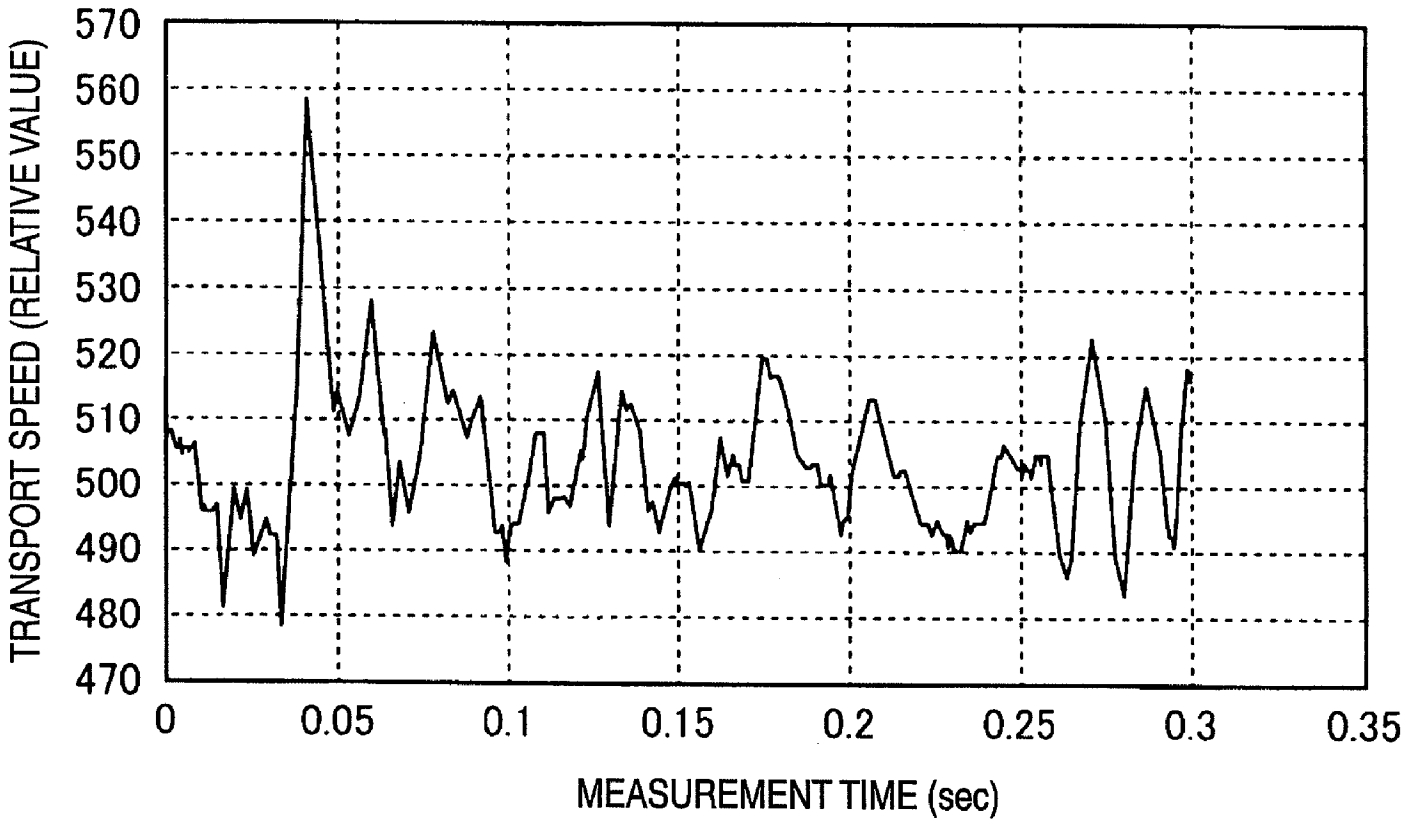
FIG. 6 is a graph showing time change of transport speed of the sheet.

FIG. 6 is a graph showing a measurement result of the change in speed of the sheet transported by the transport roll. The sheet speed shown in FIG. 6 is data obtained by a special measurement device of measuring the speed of a moving sheet by means of an optical unit.

As shown in FIG. 6, the sheet speed in the transport process varies finely in a range of ±several percentages on average. It is thought that this variation is produced by the combined influences by unevenness in rotation of the transport roll, strain in the sectional shape of the transport roll, paper floating from the transport roll, and unevenness in rotation of the motor for driving the transport roll.

For example, as the speed in the periods of ΔT1 and ΔT2, the anticipated speed can be used. However, the periods of ΔT1 and ΔT2 are generally about tens μmsec, and the variation in speed in such the short period exists in level where averaging is impossible as shown in FIG. 6 (namely, such an error that the variation is larger by several % or smaller by several % is included). Accordingly, in case that the anticipated speed is used as the speed in the periods of ΔT1 and ΔT2, possibility that the error caused by the speed variation is included in the measured value increases.

According to the exemplary embodiment, the speed V1 in the period of ΔT1 in FIG. 4 is calculated on the basis of the actual measurement value $\Delta t_1$ in the step S507. Further, the speed V2 in the period of ΔT2 is calculated on the basis of the actual measurement value $\Delta t_2$ in the step S515. Therefore, the values of Lin and Lout become closer to the actual values in which the influence of the variation shown in FIG. 6 is included comparatively exactly (become more exact values).

Namely, as clear from the calculation expressions in the steps S507 and S508, Lin is expressed by $Lin=(L4/\Delta t_1)\times\Delta T1$, in which L4 is constant (in this case, temperature dependence of L4 is ignored), and $\Delta t_1$ and ΔT1 are actual measurement values. The speed variation shown in FIG. 6 is reflected in $\Delta t_1$ and ΔT1. In other words, the influence of the speed variation shown in FIG. 6 is included in $\Delta t_1$ and ΔT1. Accordingly, the value of Lin becomes closer to the actual value in which the influence of the variation shown in FIG. 6 is included comparatively exactly (become a more exact value). This point is similar also on Lout.

From the above reason, in the technology of measuring the length of the transported recording material, the length of the recording material transported in the time below the pulse interval of the pulse signal output unit can be also calculated with high accuracy.

In case that a fine image such as a photographic image is formed by two-sided printing, there is demanding tendency for shift of images on the two sides in the paper transport direction. Further, in fine color image using comparatively much toner and image formation in which printing speed is high, there is tendency for the dimension of the sheet after fixing to change readily. In such the case, the demand for measurement accuracy of the above-mentioned Lin and Lout becomes also high. According to the exemplary embodiment, since the measurement accuracy of Lin and Lout can be heightened, the exemplary embodiment is superior in this point.

Further, in the exemplary embodiment, the influences of expansion and contraction of the base board due to the temperature can be corrected. Therefore, increase in measurement error due to the temperature change can be suppressed.

Others

In the shown length measuring part 100, the rotational shaft 103 is located on the more upstream side than the pivot shaft 105, but the rotational shaft may be located on the more downstream side than the pivot shaft 105. Further, as long the length measuring part 100 is located on the downstream side of the fixing device 400, the length measuring part 100 does not need to be located on the transport path 314 but may be arranged on the more upstream side or the more downstream side than the transport path 314.

FIG. 1 shows the constitution in which the sheet length is measured before the image formation on the second side in the image formation on the both side. However, the sheet length may be measured before the image formation on the first side to utilize the measured sheet length in the image formation on the first side. Further, in the constitution capable of forming an image not on both sides but on only one side, the sheet length may be measured before the image formation to reflect the measured result in the image formation.

The present invention can be utilized in a measuring device of recording material length. Further, the invention can be utilized in an image forming apparatus which includes this measuring device of recording material length.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A measuring device of a length of a recording material comprising:

a rotary unit that rotates while coming into contact with the recording material when the recording material is transported on the rotary unit;

a pulse signal output unit that outputs a pulse signal in response to a rotation angle of the rotary unit;

a first detection unit that detects the recording material arranged on an upstream of the rotary unit in a transport direction of the recording material;

a second detection unit that detects the recording material arranged on a downstream of the rotary unit in the transport direction of the recording material; and a calculation unit that calculates a length of the recording material, wherein the calculation unit calculates a piece of the length of the recording material corresponding to a time below a pulse interval of the pulse signal based on (i) a distance in the transport direction between the first detection unit and the second detection unit and (ii) a period in which one of the first detection unit and the second detection unit detects the recording material, and the calculation unit calculates the total length in the transport direction of the recording material based on (iii) the calculated length, (iv) the distance between the first detection unit and the second detection unit, and (v) the number of pulses outputted from the pulse signal output unit while both of the first detection unit and the second detection unit are detecting the recording material.

2. The measuring device according to claim 1, wherein:

the calculating unit calculates a first length of the recording material corresponding to the time below the pulse interval of the pulse signal based on (i) a value obtained by dividing the distance between the first detection unit and the second detection unit by a time from a detection start of the first detection unit to a detection start of the second detection unit, and (ii) a time from the detection start of the second detection unit to a rising or falling edge of a pulse waveform of the pulse signal immediately after the detection start of the second detection; and the calculating unit calculates a second length of the recording material corresponding to the time below the pulse interval of the pulse signal based on (iii) a value obtained by dividing the distance between the first detection unit and the second detection unit by a time from a detection end of the first detection unit to a detection end of the second detection unit, and (iv) a time from the detection end of the first detection unit to a rising or falling edge of a pulse waveform of the pulse signal immediately before the detection end of the first detection.

3. The measuring device according to claim 2, further comprising:

a base material on which the first detection unit and the second detection unit are arranged;

a temperature detection unit arranged between the first detection unit and the second detection unit on the base material; and a correction unit that corrects a value of the distance between the first detection unit and the second detection unit based on an output from the temperature detection unit.

4. An image forming apparatus comprising:

an image forming unit that forms an image on a recording material having a first side and a second side;

a recording material length measuring device according to claim 2, that measures a length of the recording material after forming the image formation on the first side;

an inverting unit that inverts the first and second sides of the recording material after forming the image on the first side has been performed by the image forming unit; and a control unit that controls, based on an output from the measuring device, the image formed by the image forming unit on the second side of the recording material of which the first and second sides of the recording material have been inverted by the inverting unit.

5. The measuring device according to claim 1, further comprising:

a base material on which the first detection unit and the second detection unit are arranged;

a temperature detection unit arranged between the first detection unit and the second detection unit on the base material; and a correction unit that corrects a value of the distance between the first detection unit and the second detection unit based on an output from the temperature detection unit.

6. An image forming apparatus comprising:

an image forming unit that forms an image on a recording material having a first side and a second side;

a recording material length measuring device according to claim 1, that measures a length of the recording material after forming the image formation on the first side;

an inverting unit that inverts the first and second sides of the recording material after forming the image on the first side has been performed by the image forming unit; and a control unit that controls, based on an output from the measuring device, the image formed by the image forming unit on the second side of the recording material of which the first and second sides of the recording material have been inverted by the inverting unit.

7. A non-transitory computer readable medium storing a program causing a computer to execute a process for measuring a length of a recording material, wherein a measuring device includes:

a rotary unit that rotates while coming into contact with the recording material which is transported;

a pulse signal output unit that outputs a pulse signal in response to a rotation angle of the rotary unit;

a first detection unit that detects the recording material arranged upstream of the rotary unit in a transport direction of the recording material;

a second detection unit that detects the recording material arranged downstream of the rotary unit in the transport direction of the recording material; and a calculation unit that calculates a length of the recording material, the process comprising:

calculating a piece of the length of the recording material corresponding to a time below a pulse interval of the pulse signal based on (i) a distance in the transport direction between the first detection unit and the second detection unit and (ii) a period in which one of the first detection unit and the second detection unit detects the recording material, and calculating the total length in the transport direction of the recording material based on (iii) the calculated length, (iv) the distance between the first detection unit and the second detection unit, and (v) the number of pulses output from the pulse signal output unit while both of the first detection unit and the second detection unit are detecting the recording material.

* * * * *